United States Patent [19]

Werner et al.

[11] Patent Number: 4,981,440

[45] Date of Patent: Jan. 1, 1991

[54] ELECTRIC CONNECTOR

[75] Inventors: Klaus Werner, Betzdorf; Helmut Fries, Niederdreisbach; Siegfried Kleufer, Malberg, all of Fed. Rep. of Germany

[73] Assignee: Elco Elektronik GmbH, Betzdorf, Fed. Rep. of Germany

[21] Appl. No.: 475,218

[22] Filed: Feb. 5, 1990

[30] Foreign Application Priority Data

Sep. 14, 1989 [DE] Fed. Rep. of Germany ..... 3930772

[51] Int. Cl.[5] ..... H01R 11/22

[52] U.S. Cl. ..... 439/266; 439/347; 439/372

[58] Field of Search ..... 439/259, 260, 261, 262, 439/263, 264, 265, 266, 267, 268, 269, 270, 342, 345, 347, 372

[56] References Cited

U.S. PATENT DOCUMENTS

| | | | |
|---|---|---|---|
| 3,848,222 | 11/1974 | Lightner | 439/342 |
| 4,236,190 | 11/1980 | Hollingsead et al. | 439/259 X |
| 4,787,858 | 11/1988 | Killian, Jr. | 439/372 X |
| 4,840,574 | 6/1989 | Mills | 439/372 X |

FOREIGN PATENT DOCUMENTS

| | | |
|---|---|---|
| 8505502 | 12/1985 | European Pat. Off. . |
| 0251508 | 7/1988 | European Pat. Off. . |
| 2707122 | 4/1982 | Fed. Rep. of Germany . |
| 8700210 | 8/1987 | Fed. Rep. of Germany . |

*Primary Examiner*—Neil Abrams
*Assistant Examiner*—Khiem Nguyen
*Attorney, Agent, or Firm*—Toren, McGeady & Associates

[57] ABSTRACT

An electric connector includes two complementary connector members, one of which has spring contacts as contact elements and the other has blade contacts as contact elements, wherein the contact elements are mounted in a row or in several parallel rows on base members. The base members are mounted on frame-like enclosing members of housings which extend parallel to the direction of insertion of the contact elements and which serve for the mutual guidance of the housings during the insertion. In the joined state of the connector members, the spring contacts and the corresponding blade contacts can be placed in contact with each other and out of contact from each other by means of contact slide members which are displaceable along the row or rows of contact elements. The connector members can be positively coupled transversely of the direction of insertion by means of locking slide members. The contact slide members and the locking slide members are mounted on the same connector member and are in engagement with a common swivel lever mounted on the same connector member. The engagement between the contact members and the locking slide members is such that, during the coupling procedure as well as during the uncoupling procedure, initially only the locking slide members are movable and the contact slide members are movable subsequently.

12 Claims, 7 Drawing Sheets

ELECTRIC CONNECTOR

BACKGROUND OF THE INVENTION

1. Field of the Invention

The present invention relates to an electric plug and socket-type connector composed of two complementary plug and socket-type connector members, wherein one connector member has contact elements in the form of spring contacts and the other connector member has contact elements in the form of blade contacts, and wherein the contact elements permit during the coupling procedure an insertion of the connector members into each other without requiring force.

Electric connectors of this type are also called zero insertion force connectors.

2. Description of the Related Art

In known electric connectors of the above-described type, the contact elements are supported in base members and are arranged in a row or in several parallel rows. In the connected state of the connector members, the contact elements can be placed in contact with each other and can be disconnected by means of contact slide members which are displaceable along the row or rows of contact elements.

Electric plug and socket-type connectors of the above-described type in the form of zero insertion force connectors are already known, as described, for example, in European patent application Nos. 0,180,612 (WO 85/05 502) and 0,251,508. In these electric connectors, one of the connector members is formed by a circuit board which can be brought with its contact elements through a longitudinal slot of the other connector member into the region of the contact elements of the latter, wherein the contact elements are formed, for example, by spring contacts.

However, similar zero insertion force connectors have become known, for example, as disclosed in German patent No. 2,707,122, in which none of the complementary connector members is required to consist of a circuit board. Rather, the contact elements, for example, in the form of spring contacts and blade contacts, are mounted on base members in housings and/or on ledges which can be plugged into each other while being mutually guided and in which the corresponding contact elements can be placed into and out of contact by actuating a slide member.

All of the above-described electric connectors constructed as so-called zero insertion force connectors have the disadvantage that the two connector members which are connected to each other are held together exclusively by means of the released spring force of the contact elements constructed as spring contacts. It may therefore happen that the two connector members are disconnected unintentionally or in an undesirable manner, particularly when vibrations occur, which may result in a disengagement of the interacting contact elements.

In another known type of electric connector, the two connector members must be joined together by overcoming the spring force inherent in the cooperating contact elements. Such a connector is described in German Utility Model No. 87 00 210. In this connector, a swivel lever is mounted on one of the connector members. The swivel lever interacts with locking slide members which are equipped with detents or locking slots. The corresponding other connector member has locking cams which interact with the detents or locking slots in such a way that the two connector members are forcibly moved relative to each other when the swivel lever is moved. Thus, the connector members are moved toward each other when the contact elements are coupled and away from each other when the contact elements are uncoupled.

It is, therefore, the primary object of the present invention to improve the described electric plug and socket-type connector in the form of a zero insertion force connector. Specifically, the two connector members are to be coupled in a positively locking manner as long as the contact elements are in spring-biased contact. In addition, it is to be ensured that the two connector members can be joined together and separated from each other only when the contact between the contact elements is cancelled.

SUMMARY OF THE INVENTION

In accordance with the present invention, an electric connector of the above-described type includes two complementary connector members, one of which has spring contacts as the contact elements and the other has blade contacts as the contact elements, wherein the contact elements are mounted in a row or in several parallel rows on base members. The base members, in turn, are mounted in frame-like enclosing members of housings and/or ledges which extend parallel to the direction of insertion of the contact elements and which serve for the mutual guidance of housings and/or ledges during the insertion. In the joined state of the connector members, the spring contacts and the corresponding blade contacts can be placed in contact with each other and out of contact from each other by means of contact slide members which are displaceable along the row or rows of contact elements. The connector members can be positively coupled transversely of the direction of insertion by means of locking slide members. The contact slide members and the locking slide members are mounted and/or guided on the same connector member. The contact slide members and the locking slide members are in engagement with a common swivel lever which is mounted on the same connector member. The engagement between the contact slide member and the locking slide member is such that, during the coupling procedure as well as during the uncoupling procedure, initially only the locking slide member is movable and the contact slide member is movable subsequently after a certain period of time.

The electric connector according to the present invention meets the objects mentioned above.

In accordance with another further development of the invention, the locking slide members and the contact slide members are mounted on the connector member with the spring contact. In accordance with another advantageous feature, the spring contacts are movable by the contact slide members against the spring bias in order to place them out of contact from the blade contacts of the other connector member.

In accordance with another feature, the contact slide members are coupled to the locking slide members through an intermediately arranged slipping or no-load device. The slipping or no-load device may be a slot and pin connection.

In accordance with another advantageous feature of the invention, a locking slide member each is provided at the two outer longitudinal sides of the connector member with the spring contacts. The two locking slide members are mounted on the sides of a stirrup, the web or bight of which extends in front of a transverse side of the connector member.

All contact slide members of the electric connector according to the invention may include a common push rod which is in engagement through a transverse member extending parallel to the web of the stirrup with oblong holes provided in the two stirrup sides. On the other hand, each locking slide member may have a locking cam or pin which interacts with locking guide slots which are open at one end thereof and are provided in the longitudinal side walls of the second connector member.

In accordance with another useful feature of the present invention, the locking slide members are arranged at a distance from and parallel to the inner surfaces of the stirrup sides and carry at the outer sides of their free ends the locking cam or pin. In this case, the locking slide members act on the inner surfaces of the second connector member.

In accordance with another feature, each contact slide member is equipped for each spring contact with an adjusting wedge, wherein a free space is provided at the contact slide members in front of each adjusting wedge, and wherein the corresponding spring contact is movable as a result of its spring action into the free space.

In accordance with a further development of the connector of the present invention, a spring tongue is provided at the end of each stirrup side. Each spring tongue has locking elements which are in engagement with locking engagement means which are provided at the longitudinal sides of the connector member and are used in at least the engaged position of the locking slide members.

In accordance with a further development of the invention, the locking guide slots for the locking slide members may also be provided at or near an end of the second connector member in the longitudinal side walls thereof, while a cutout is provided in the transverse wall and at the other end thereof. Simultaneously, the first connector member has a projection at the transverse wall of its end remote from the control slide members. The projection fits into and is engageable with the cutout. These features are provided in order to prevent the joining of the two connector members of an electric connector when the locking slide members are in the locking position.

The various features of novelty which characterize the invention are pointed out with particularity in the claims annexed to and forming a part of this disclosure. For a better understanding of the invention, its operating advantages attained by its use, reference should be had to the drawing and descriptive matter in which there are illustrated and described preferred embodiments of the invention.

DESCRIPTION OF THE PREFERRED EMBODIMENTS

Figure 1:
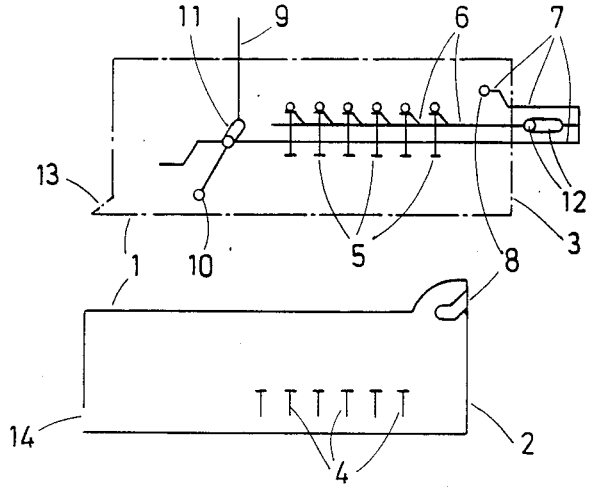
FIG. 1 is a schematic basic illustration of the electric connector according to the present invention in the form of a zero insertion force connector, wherein the two connector members are completely separate from each other.

FIGS. 1–4 of the drawing are schematic illustrations of an electric connector according to the present invention. The connector is a so-called zero insertion force connector 1 and includes two complementary connector members 2 and 3. Connector member 2 preferably is a stationary or mounted member, while the connector member 3 is a movable connector member.

The characteristic feature of such zero insertion force connectors 1 is the fact that the connector members 2 and 3 can be connected and disconnected without requiring any contact pressure forces between the elements which come into contact with each other, i.e. contact elements 4 and 5. The contact elements 4 are constructed as so-called blade contacts 4 which are mounted in the stationary or mounted connector member 2. The contact elements 5 are preferably spring contacts which are mounted in the movable connector member 3.

For simplicity's sake, the contact elements 4 are not shown as blade contacts and the contact elements 5 are not shown as spring contacts.

The contact elements 4 in the stationary or mounted connector member 2 as well as the contact elements 5 in the movable connector member 3 are arranged in a row or in several parallel rows, as schematically illustrated in FIGS. 1–4.

As mentioned above, a significant aspect of a zero insertion force connector 1 is the fact that it is not necessary to overcome any contact forces when the connector members are plugged together or when they are pulled apart from each other. On the other hand, it is also important that the two connector members 2 and 3 can be locked together even before the contact elements 4 and 5 come into contact with each other and that they can only be unlocked after the contact elements 4 and 5 have previously been placed out of contact.

In order to make possible the manner of operation described above, the zero insertion force connector 1 includes contact slide members 6 for the contact elements 5 which are constructed, for example, as spring contacts and are mounted in the movable connector member 3. The contact slide members 6 are used to move the contact elements or spring contacts 5 optionally into and out of contact with the contact elements or blade contacts 4 in the stationary connector member 2. In addition, locking slide members 7 are provided in the movable connector member 3. The locking slide members 7 serve to actuate locking devices 8 which are provided between the stationary or mounted connector member 2 and the movable connector member 3.

It has not only been found important that the contact slide members 6 and the locking slide members 7 are mounted and/or guided on the same connector member 2 or 3, preferably on the movable connector member 3. Rather, it is also very important that the contact slide members 6 and the locking slide members 7 are arranged so as to interact in a specific manner with each other.

Thus, after the two connector members 2 and 3 of the zero insertion force connector 2 have been joined in accordance with the sequence illustrated in FIGS. 1–3, the actual coupling procedure is to be carried out by initially only actuating the locking slide members 7 and by actuating the contact slide members 6 only subsequently after a certain period of time. For the coupling procedure it is important that initially only the locking slide members 7 are moved and the contact slide members 6 are moved subsequently, and that the locking devices 8 can only be completely disengaged after the contact elements 5 have been lifted off or separated from the contact elements 4.

The locking slide members 7 as well as the contact slide members 6 are actuated by means of a swivel lever 9 which is mounted in bearing points 10 in the movable connector member 3. The swivel lever 9 acts on the locking slide members 7 through a pin and slot-connection 11, while the contact slide members 6 are in connection with the locking slide members 7 again through a pin and slot-connection 12.

Figure 2:
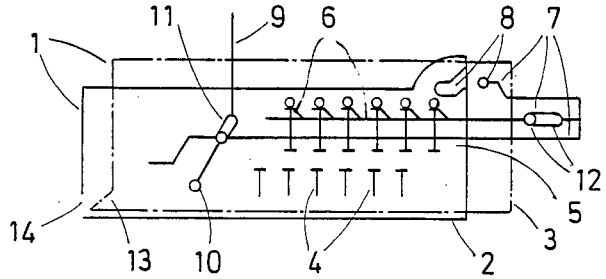
FIG. 2 is a schematic basic illustration of the connector according to FIG. 1 in which the two connector members are joined but not yet locked together and the contact elements are not in contact.
Figure 3:
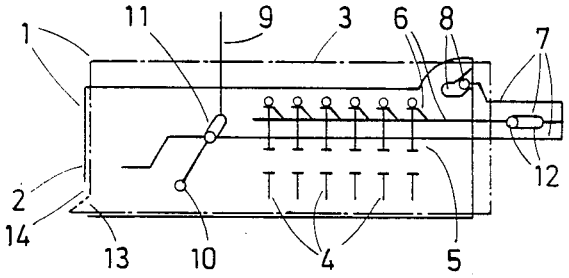
FIG. 3 is an illustration corresponding to FIG. 2, wherein the two connector members are mechanically locked together, while the contact elements are not yet in contact.

The movable connector member 3 and the stationary or mounted connector member 2 are joined together in the sequence illustrated in FIGS. 1–3 by means of a projection 13 on the connector member 3 and a recess 14 on the connector member 2 at the end of the zero insertion force connector 1 which is remote from the locking devices 8. As a result, not only the projection 13 and the recess 14 of the two connector members 2 and 3 are engaged with each other, but the locking devices 8 between the two connector members 2 and 3 are also joined together. In addition, the contact elements 5 of the movable connector member 3, i.e., the spring contacts 5, are moved into a position which is adjacent to the corresponding contact elements 4 of the stationary or mounted connector member 2, i.e., the blade contacts 4, without coming into contact with the contact elements 4.

Figure 4:
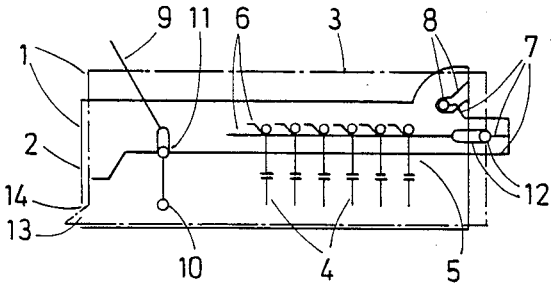
FIG. 4 is an illustration corresponding to FIG. 3, wherein the contact elements of the two connector members are in contact with each other.

When the swivel lever 9 is moved from the initial position illustrated in FIGS. 1–3 into the end position shown in FIG. 4, initially only a movement of the locking slide member 7 takes place to further engage the locking devices 8. As a result, the connector members 2 and 3 of the zero insertion force connector 1 are clamped together by means of the locking devices 8. The contact slide members 6 are moved from the position shown in FIGS. 1 to 3 into the position shown in FIG. 4 only after the play in the pin and slot-connection 12 between the locking slide members 7 and the contact slide members 6 has been overcome. Consequently, the contact elements 5, i.e., the spring contacts 5 of the movable connector member 3 come into contact with the contact elements 4, i.e., the blade contacts 4 of the stationary or mounted connector member 2. As clearly shown in FIG. 4, the electric connector constructed as a zero insertion force connector is only now effective.

The uncoupling procedure of the zero insertion force connector 1 is carried out by moving the swivel lever 9 back from the end position shown in FIG. 4 to the initial position shown in FIGS. 1–3 which initially only causes the locking slide member 7 to be moved and the contact slide members 6 are only subsequently displaced after the slipping path of the pin and slot-connection 12 has been overcome.

However, only when the contact slide members have again reached the position shown in FIG. 3, i.e., the contact elements or springs 5 of the movable connector member 3 are out of contact from the contact elements or blade contacts 4 of the stationary or mounted connector member 2, the locking devices 8 between the connector members 2 and 3 have reached a position which permits the uncoupling procedure in accordance with the sequence of movements illustrated in FIGS. 3 to 1.

It has been found to be particularly advantageous and useful if the contact slide members 6 interact with the contact elements 5 in the form of spring contacts of the movable connector member 3 in such a way that the latter must be moved by the contact slide members 6 against the spring bias force thereof to move them out of contact with contact elements 4 in the form of blade contacts of the stationary or mounted connector member 2. After the contact slide members 6 have been moved back into the basic position thereof, the spring contacts 5 come into contact with the blade contacts 4 as a result of the spring bias force of the spring contact 5.

The pin and slot-connections 12 between the locking slide members 7 and the contact slide members 6 each form a slipping device which ensures the correct sequence of movements of the contact slide members 6 and of the locking slide members 7 during the coupling procedure as well as of the uncoupling procedure of the zero insertion force connector 1.

A preferred embodiment of the electric connector in the form of zero insertion force connector 21 shall be explained below with the aid of FIGS. 5–16 of the drawing.

Figure 5:
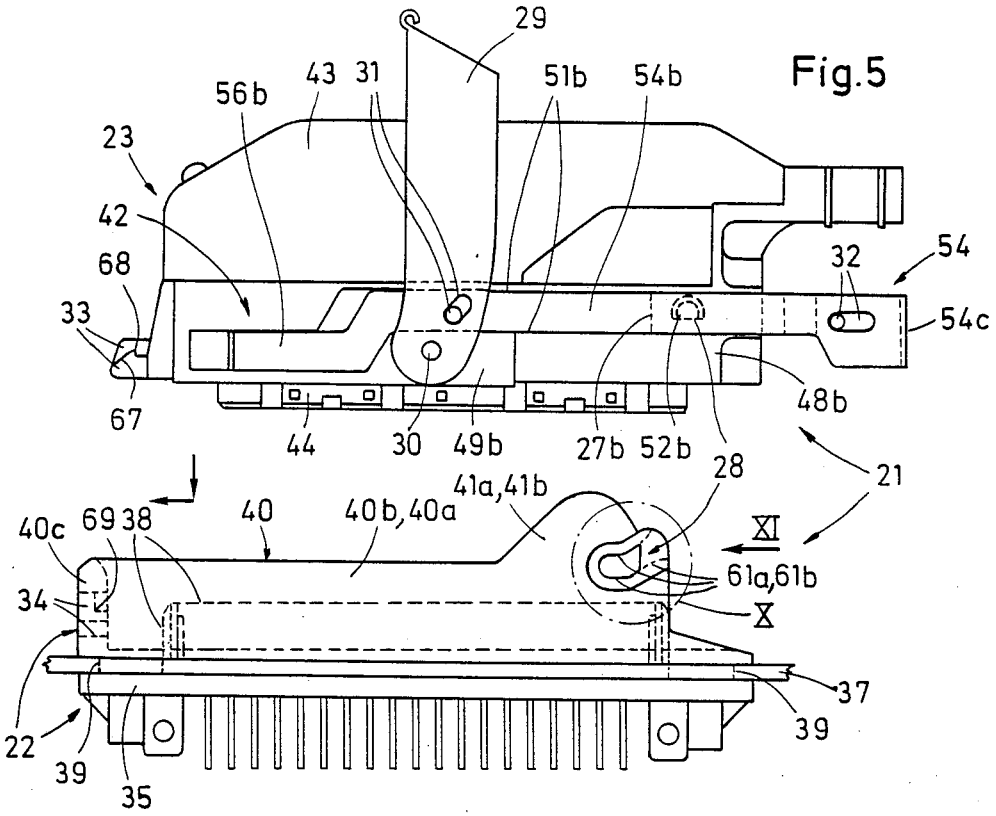
FIG. 5 is a side view showing the two connector members in approximately actual size and in the position corresponding to FIG. 1, i.e., prior to joining of the connector members.
Figure 6:
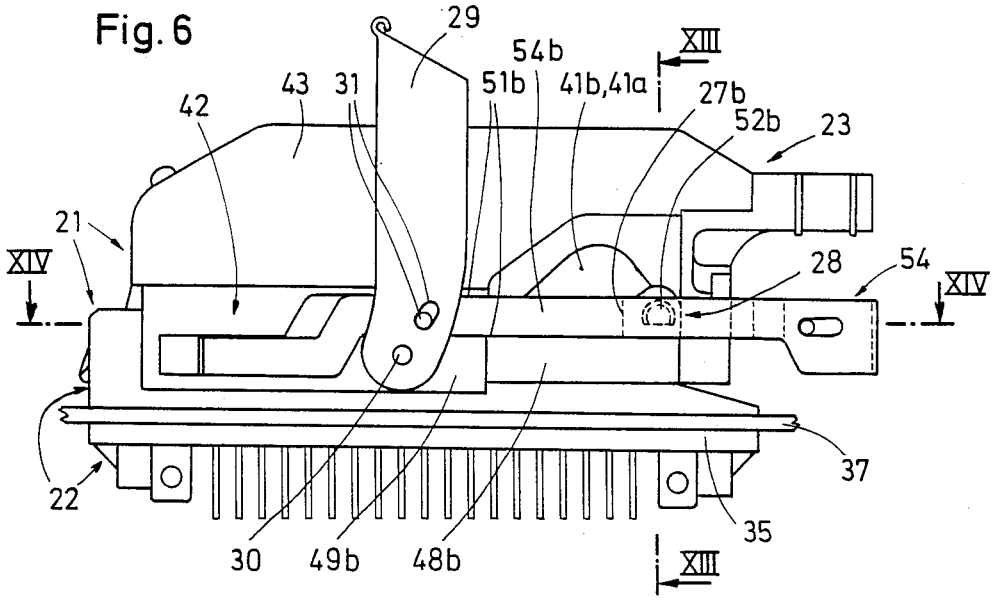
FIG. 6 is a side view corresponding to FIG. 5 showing the two connector members in the position corresponding to FIG. 3.
Figure 7:
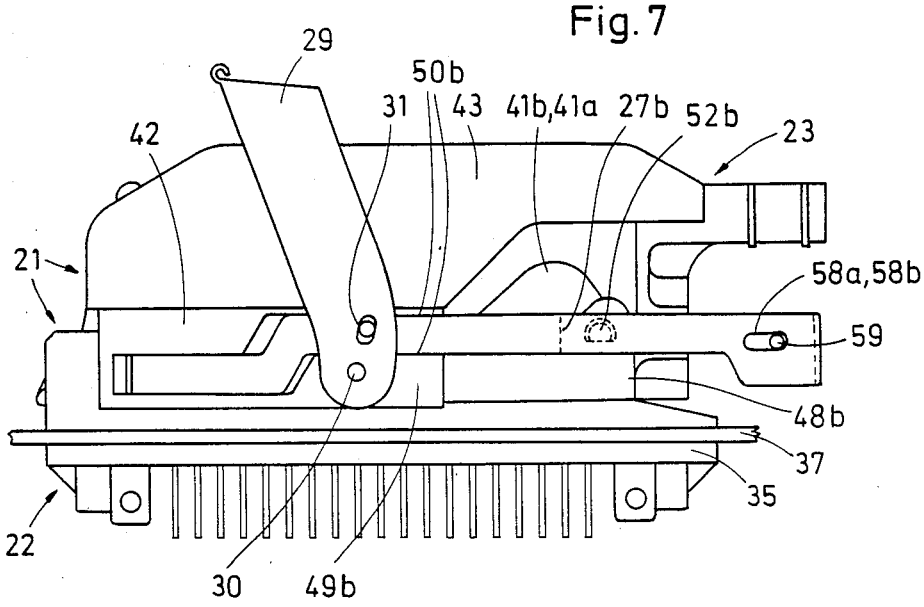
FIG. 7 is a side view corresponding to FIG. 5, showing the connector members in an intermediate position of operation.
Figure 8:
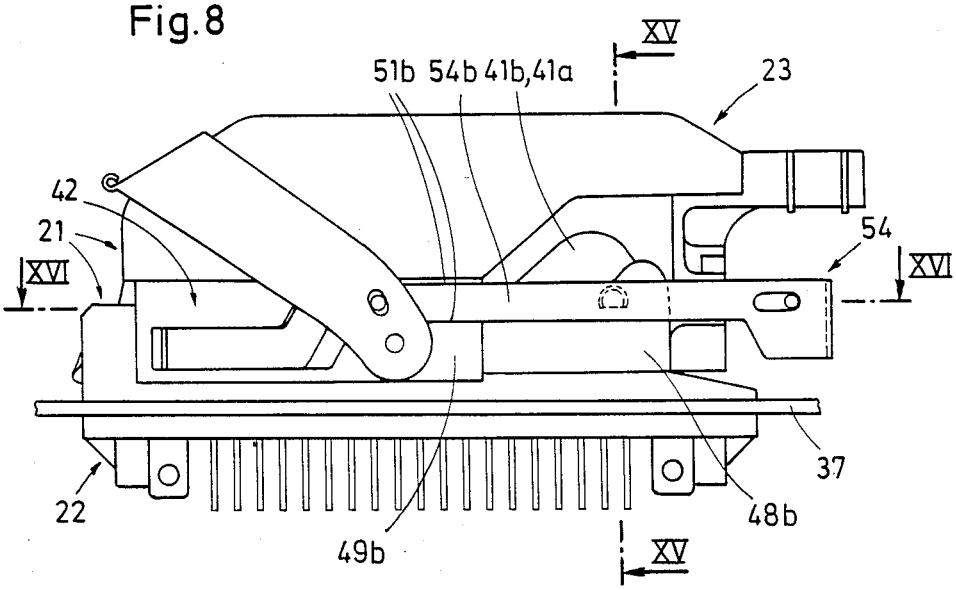
FIG. 8 is a side view corresponding to FIG. 5, showing the two connector members in the position corresponding to FIG. 4.

The zero insertion force connector 21 again includes a stationary or mounted connector member 22 and a movable connector member 23. FIG. 5 shows the two connector members 22 and 23 in a relative position which corresponds to that of FIG. 1. FIG. 6 shows two connector members 22 and 23 in the position corresponding to FIG. 3, while FIG. 8 shows the two members 22 and 23 in the coupling position corresponding to FIG. 4. In FIG. 7, the two connector members 22 and 23 of the zero insertion force connector 21 are shown in an intermediate coupling position.

Figure 13:
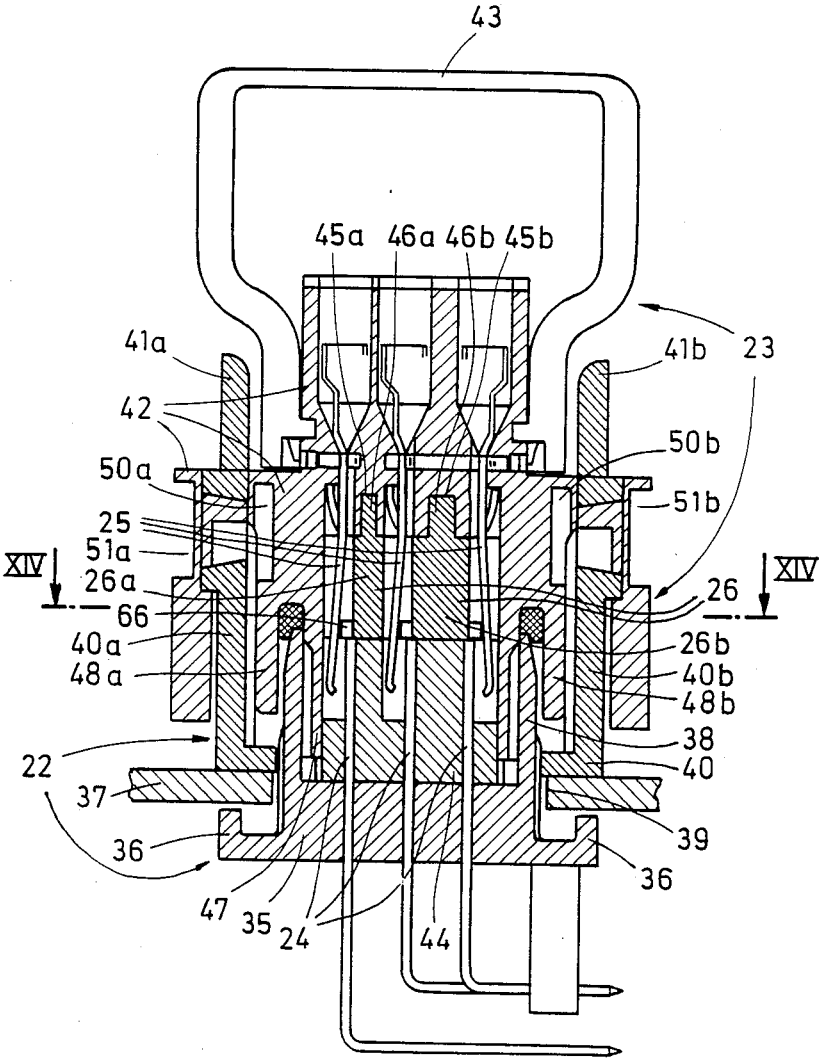
FIG. 13 is a sectional view, on a larger scale, taken along sectional line XIII—XIII in FIG. 6.
Figure 15:
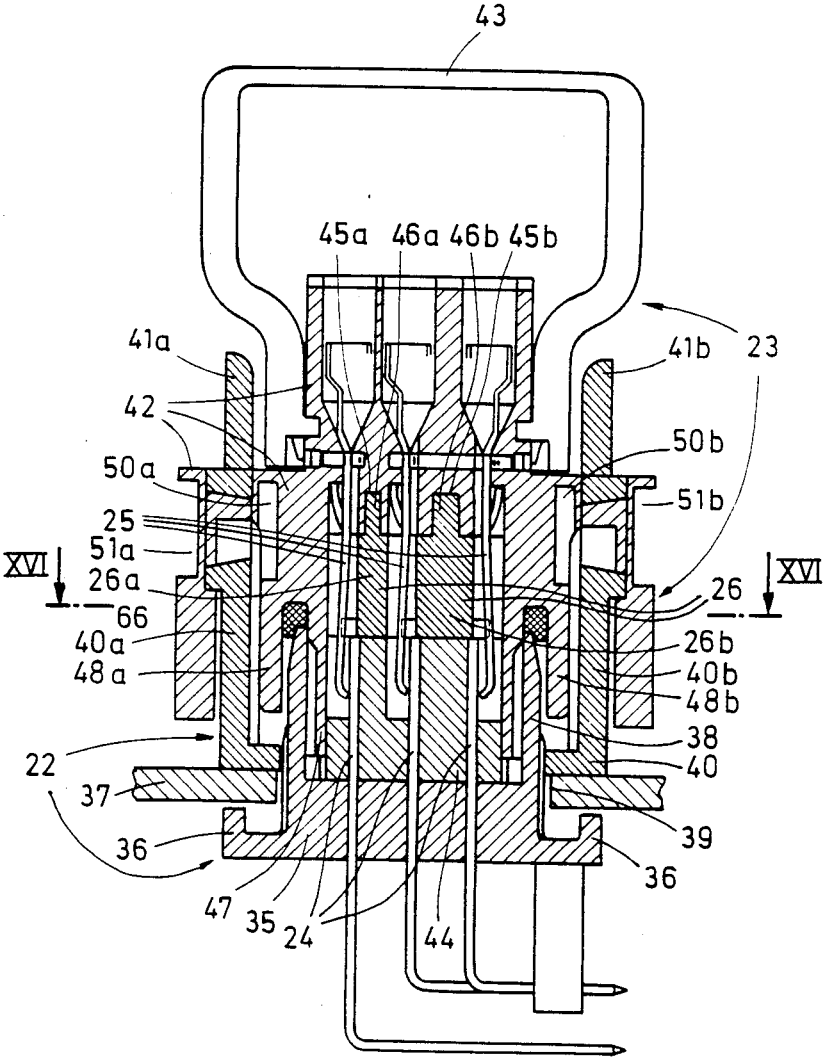
FIG. 15 is a sectional view, on a larger scale, taken along sectional line XV—V in FIG. 8.

As FIGS. 13 and 15 of the drawing show, the contact elements in the form of blade contacts 24 are mounted in the stationary or mounted connector member 22, while the contact elements in the form of spring contacts 25 are mounted in the movable connector member 23 and interact in connector member 23 with the contact slide members 26.

As FIGS. 13 and 15 further show, the blade contacts 24 as well as the spring contacts 25 are arranged in three rows next to each other and contact slide member 26 consists of two parallel side members 26*a* and 26*b*. The slide member 26*a* interacts only with a row of the spring contacts 25, while the side member 26*b* simultaneously interacts with the two other rows of spring contacts 25.

However, FIGS. 13 and 15 of the drawing do not show the locking slide members 27, the locking devices 28 and the swivel lever 29 and the bearing points 30 for the swivel lever 29. These components will be discussed below in connection with other figures of the drawing.

FIGS. 5–8 and FIGS. 13 and 15 of the drawing show that the stationary or mounted connector member 22 includes a base member 35 in which the blade contacts 24 are mounted. This base member 35 has border flanges 36 which rest against the bottom side of a fastening plate 37. The fastening plate 37 may be, for example, a circuit board. A collar 38 of the base member 35 extending essentially parallel to the blade contacts 24 engages through a cutout or recess 39 of the fastening plate 37 and projects to a significant extent beyond the upper side of the fastening plate 37, as clearly shown in FIGS. 13 and 15.

The stationary or mounted connector member 22 further includes a frame 40 which is placed on the upper side of the fastening plate 37 and is connected to the base member 35, for example, by means of screws. By tightening the screws, the stationary connector member is clamped against the fastening plate 37, so that resting against it are from below the border flanges 36 of the base member 35 and from above the frame 40 of the fastening plate 37. The frame 40 includes longitudinal walls 40*a* and 40*b* which extend spaced from and parallel to the longitudinal wall of the collar 38 of the base member 35 and, as can be seen not only in FIGS. 13 and 15 but also in FIG. 5 of the drawing, protrude upwardly above the base member 35. Moreover, the two longitudinal walls 40*a* and 40*b* of the frame 40 extend integrally at one end thereof beyond a transverse wall 40*c*, as indicated in FIG. 5.

Each of the two longitudinal walls 40*a* and 40*b* has a web-like raised portion 40*a*, 41*b* at an end of the frame 40 which faces away from the transverse wall 40*c*. The web-like raised portions 41*a* and 41*b* can be seen in FIGS. 5–8 and in FIGS. 13 and 15.

As FIGS. 5–8 and 13–15 further show, the spring contacts 25 in the movable connector member 23 of the zero insertion force connector 21 are mounted in a base member 42. A hood 43 is placed on the base member 42. The hood 43 may be slidable in longitudinal direction onto the base member 42 and/or my be lockable to the base member 42. Hood 43 serves to receive, for example, electric conductors, such as cables, the connection ends of which can be connected to spring contacts 25, for example, by crimping.

The base member 42 receives from below an insert 44 which not only surrounds the free ends of the spring contacts 25 with sufficiently large play, but also includes guide ducts through which the individual blade contacts 24 of the stationary or mounted connector member 22 can be exactly guided into the range of operation of the spring contacts 25, as shown in FIGS. 13 and 15. As also shown in FIGS. 13 and 15, the two side members 26*a* and 26*b* of the contact slide member 26 are guided exactly longitudinally movable in the region between the insert 44 and the base member 42 and between the three rows of spring contacts 25. The inner end face of the insert 44 merely serves as a support for each side member 26*a* and 26*b* of the contact slide member 26, while the opposite end face of the base member 42 has offset longitudinal grooves 45*a* and 45*b* which are engaged by correspondingly offset longitudinal ledges at the upper side of each side member 26*a* or 26*b* to form a positive engagement.

The base member 42 not only surrounds the insert 44 with a collar 47 which, in turn, can be inserted in the collar 38 of the stationary connector member 22. Rather, additional inner longitudinal webs 48*a* and 48*a* extend spaced apart and parallel to the two longitudinal sides of the collar 47 and outer longitudinal webs 49*a* and 49*b* are provided spaced apart from the inner longitudinal webs 48*b* and 48*a*, as shown in FIGS. 13 and 15.

The collar 38 of the stationary or mounted connector member 22 is received between the collar 47 and the inner longitudinal webs 48*a*, 48*b*, while the longitudinal walls 40*a* and 40*b* of the frame 40 are received between inner longitudinal web 48*a* and 48*a* and an outer longitudinal web 49*a* and 49*b*.

Longitudinal ducts 50*a* and 50*b* are provided in the base member 42 above the inner longitudinal webs 48*a* and 48*a* and laterally open longitudinal grooves 51*a* and 51*b* are provided in the outer surfaces of the outer longitudinal webs 49*a* and 49*b* on the same level as the longitudinal ducts 50*a* and 50*b*.

Figure 9:
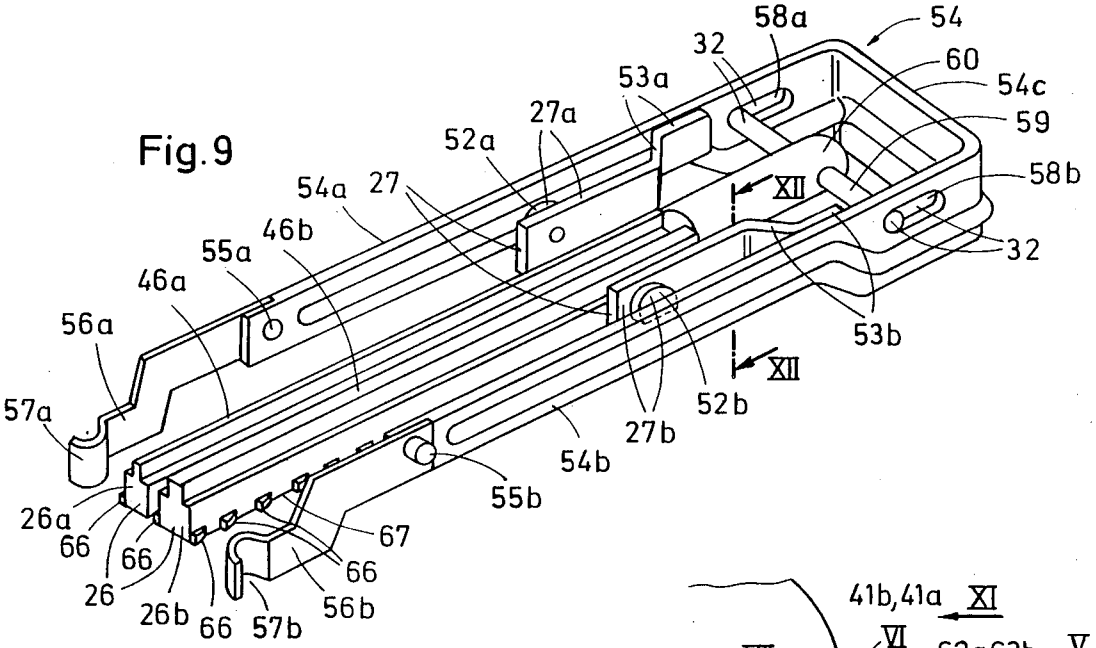
FIG. 9 is a perspective top view of structural components of the connector which are essential for the operation thereof and which are mounted on the movable connector member.

The locking slide members 27 mentioned above for actuating the locking devices 28 can be seen in FIG. 9 of the drawings. Specifically, two locking slide members 27*a* and 27*b* of mirror-inverted construction are provided. The two locking slide members 27*a* and 27*b* are laterally spaced from each other at a distance which corresponds to the distance between the two longitudinal ducts 50*a* and 50*b* which are provided in the base member 42 of the movable connector member 23. Accordingly, each of the two locking slide members 27*a* and 27*b* can be exactly longitudinally movably guided in one of the longitudinal ducts 50*a* and 50*b* of the base member 42.

Each locking slide member 27*a* and 27*b* has a locking cam 52*a* and 52*b* near its end and on its outer surface, while the other end has an outwardly bent portion 53*a* and 53*b* which is fastened to the inner surface of a side 54*a* and 54*b* of a stirrup 54. The two sides 54*a* and 54*b* of the stirrup 54 are connected integrally to each other by means of a web 54*c*.

Figure 12:
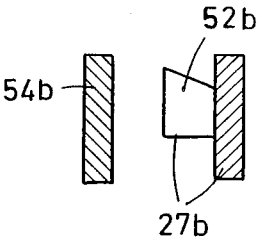

The locking slide members 27*a* and 27*b* are arranged on the sides 54*a* and 54*b* of the stirrup 54 in such a way that the free end faces of the locking cams 52*a* and 52*b* still have a distance from the inner surface of the side 54*a* and 54*b* , as can be seen particularly clearly in FIG. 12.

The sides 54a and 54b of the stirrup 54 are slidingly guided in the longitudinal grooves 51a and 51b of the base member 42, while the web 54c of the stirrup 54 extends freely transversely at a relatively large distance in front of an end of the base member 42, particularly in front of the rear end thereof.

The sides 54a and 54b of the stirrup 54 each have a pin 55a, 55b which projects beyond the outer surface of the stirrup 54 and interacts with a swivel lever 29 which is pivotally mounted in bearing points 30 of connector member 23 at the outer surface of the outer longitudinal webs 49a and 49b of the base member 42. The pins 55a and 55b are provided in order to form together with the swivel lever 29 pin and slot-connections 31 which had already been mentioned above. The pin and slot-connections 31 between the swivel lever 29 and the sides 54a and 54b of the stirrup 54 have the purpose to produce an exact longitudinal displacement of the stirrup 54 in the longitudinal grooves 51a and 51b of the base member 42 from the swivel movement of the swivel lever 29, without resulting in any jams between these members.

A spring tongue 56a and 56b, respectively, is rigidly connected to the sides 54a and 54b of the stirrup 54 through the pins 55a and 55b. The spring tongues 56a and 56b have end portions 57a, 57b which are downwardly offset and inwardly bent in the shape of a loop. The end portions 57a and 57b of the spring tongues 56a and 56b may interact with locking recesses and/or locking projections at the outer side surfaces of the base member 42 in order to fix the initial position shown in FIGS. 5 and 6 and the end position shown in FIG. 8 of the stirrup 54 with respect to the movable connector members 23.

The sides 54a and 54b of the stirrup 54 each have an oblong hole 58a, 58b which is provided at a distance from the web 54c and extends parallel to the longitudinal direction of the sides 54a and 54b. The end of a transverse bolt 59 extends into each of the oblong holes 58a and 58b and thereby forms the above-mentioned pin and slot-connections 32. The transverse bolt 59 extends through the end of a shaft 60 which extends parallel to the sides 54a and 54b of the stirrup 54 and, as clearly indicated in FIG. 9, is connected to the rearward ends of the two side members 26a and 26a of the contact slide member 26.

The pin and slot-connections 32 act as slipping or idling devices between the locking slide members 27a, 27b and the side members 26a, 26a of the contact slide member 26. An important aspect of the pin and slot-connections 32 is that the locking slide members 27a, 27b and the contact slide members 26, 26a, 26a not only travel different distances when the swivel lever 29 is actuated, but are additionally displaced delayed one after the other. FIGS. 5 and 6 of the drawing show the initial position of the swivel lever 29 and the stirrup 54, while FIG. 8 of the drawing shows the end position of the swivel lever 29 and the stirrup 54.

When the swivel lever 29 and the stirrup 54 are in the initial position, the movable connector member 23 can be separated without problems from the stationary or mounted connector member 22, as is clear from FIG. 5. However, in this initial position, the movable connector member 23 can also be joined with the stationary or mounted connector member 23 by moving the connector members from the position shown in FIG. 5 to the position shown in FIG. 6. In FIG. 5, the locking devices 28 between the two connector members 22 and 23 are disengaged, while they are in engagement in FIG. 6.

The locking devices 28a are formed by locking cams 52a and 52b of the locking slide members 27a, 27b which interact with locking guide slots 61a and 61b which are provided at the inner surfaces of both longitudinal walls 40a and 40b of the frame 40 in the region of the web-like extensions 41a and 41b of the stationary or mounted connector member 22. The arrangement and shape of the locking guide slots 61a, 61b is particularly clearly illustrated in FIGS. 5 and 10 of the drawing, while the profile thereof can be seen in FIG. 11.

Figure 11:
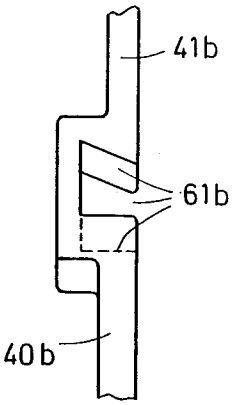
FIGS. 11 and 12 are views seen in the direction of arrow XI of FIGS. 5 and 10.
Figure 10:
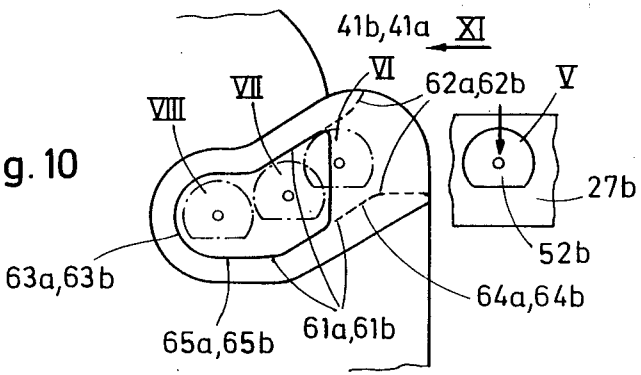
FIG. 10 shows a detail, on a larger scale, indicated in FIG. 5 by X, wherein an interacting structural component of the components shown in FIG. 9 is illustrated in four different positions of operation which correspond to those illustrated in FIGS. 5–8.

Each locking guide slot 61a and 61b has an open inlet region 62a, 62b which is located vertically higher at the web-like extensions 41a, 41b than the closed end regions 63a, 63b. As shown in FIG. 10, a downwardly inclined portion 64a, 64b is provided adjacent the inlet region 62a, 62b and each closed end portion 63a, 63b of the locking guide slots 61a, 61b has a horizontal portion. Each locking guide slot 61a, 61b is undercut in cross-section in the shape of a trapeze or dovetail, as shown in FIG. 11, and the locking cams 52a and 52b of the locking slide members 27a and 27b have a corresponding shape, as shown in FIGS. 10 and 12.

When the movable connector member 23 is joined with the stationary connector member 22 in accordance with the sequence of movements illustrated in FIGS. 1–13, initially the locking cams 52a, 52b of the locking slide members 27a, 27b successively reach the positions relative to the locking guide slots 61a, 61b which are indicated in FIG. 10 by V and VI, which correspond to the positions shown in FIGS. 5 and 6 of the drawing. When the swivel lever 29 is moved from its basic position shown in FIGS. 5 and 6 into the intermediate position shown in FIG. 7, the locking cams 52a, 52b assume in the locking guide slots 61a, 61b the relative position indicated in FIG. 10 by VII. At the same time, the stirrup 54 and the two locking slide members 27a and 27b have been displaced, so that the oblong holes 58a, 58b of the pin and slot-connections 32 have moved away with the forward ends thereof from the transverse bolt 59 and have approached the transverse bolt 59 with the rearward end thereof, as can be seen in FIG. 7. The transverse bolt 59 can be moved only after the swivel lever 29 has been moved from its position shown in FIG. 7 into the position shown in FIG. 8. Simultaneously, the locking cams 52a, 52b have been moved from the position VII into the position VIII shown in FIG. 10.

Figure 14:
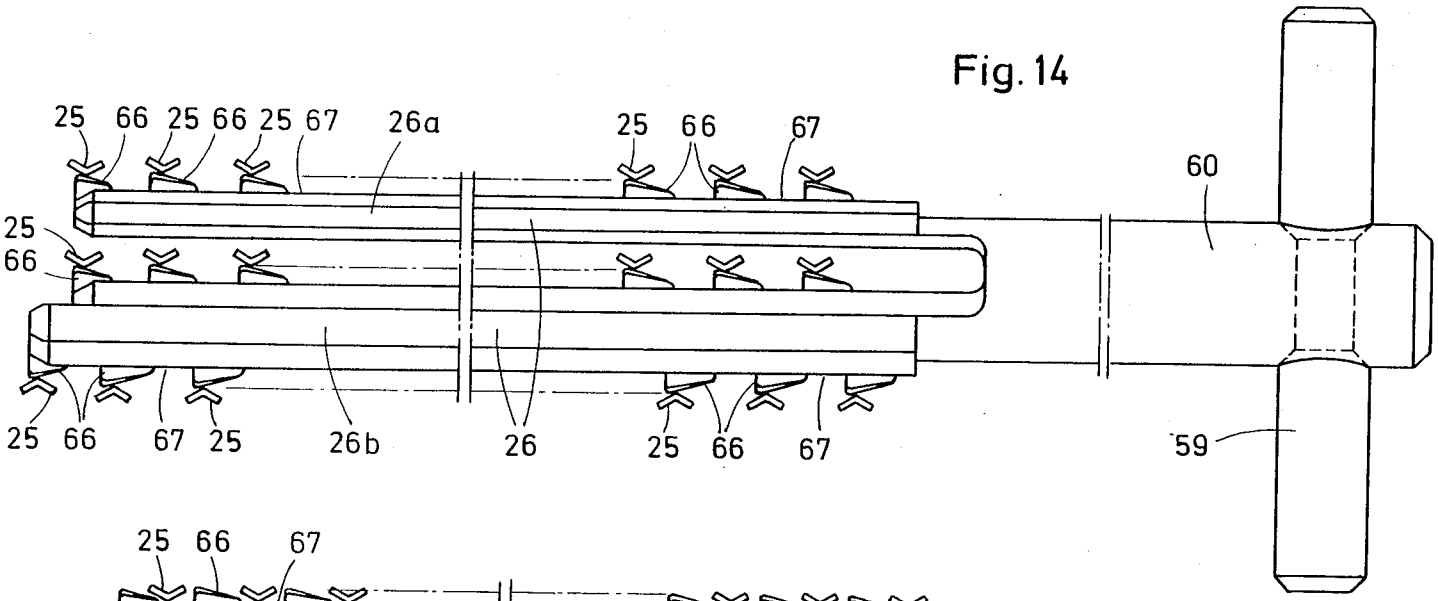
FIG. 14 is a sectional view along sectional line XIV—XIV in FIG. 6 showing the two end portions.
Figure 16:
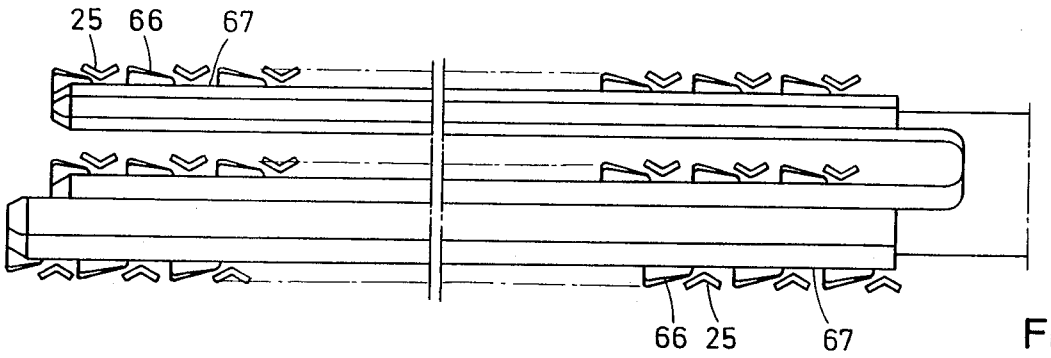
FIG. 16 is a sectional view taken along sectional line XVI—XVI in FIG. 8 also showing only the two end portions.

The movement of the locking devices 28 into the locked end position shown in FIG. 8 also causes the shaft 60 to displace the contact slide member 26 with its side members 26a and 26a, i.e., from the initial position shown in FIG. 14 into the end position shown in FIG. 16.

In the initial position of the side members 26a and 26a of the contact side member 26 shown in FIG. 14, the spring contacts 25 of the movable connector member 23 which interacts with the contact slide member 26 assume the position shown in FIG. 13, i.e., a raised position relative to the blade contact 24 of the stationary or mounted connector member 22. On the other hand, in the end position of the side members 26a and 26a of the contact slide member 26, the spring contacts 25 of the movable connector member 23 are in contact with the blade contacts 24 of the stationary or mounted connector member 22, as shown in FIG. 15.

It should be mentioned at this point that in the case of the zero insertion force connector 21 according to FIGS. 5–16, the spring contacts are shaped and arranged in such a way that the own spring tension thereof causes them to come into contact with the blade contacts 24 of the stationary or mounted connector member 22. Accordingly, in order to cancel the contact with the blade contacts 24, the spring contact 25 must be moved against the spring tension by means of the contact slide side members 26*a* and 26*b*.

FIG. 9 and particularly FIGS. 14 and 16 show that the contact slide side member 26*b* has an outer surface and the contact slide side member 26*a* has on its outer end on its inner longitudinal surface an adjusting wedge 66 for each spring contact 25. The adjusting wedges 66 are provided on the contact slide side members 26*a* and 26*b* in such a way that a free space 67 exists in front of each individual adjusting wedge 66, as illustrated in FIG. 9 and in FIGS. 14 and 16.

When the contact slide member 26*a* and 26*b* is in the initial position, the adjusting wedges 66 are placed against the spring contacts 25 and hold the spring contacts 25 against he spring tension thereof, so that they do not come into contact with the blade contacts 24, even if the two connector members 22 and 23 of the zero insertion force connector 21 have been joined together, as shown in FIGS. 6 and 14. However, when the contact slide member 26 with its side members 26*a* and 26*b* is moved into its end position, as seen in FIGS. 8 and 16, the adjusting wedges 66 slide away from the spring contacts 25 and the wrapper can now be moved by their own tension to the free spaces 67. As a result, the contacts 25 are moved away from the position shown in FIG. 13 and into contact with the blade contacts 24 as shown in FIG. 15, so that the zero insertion force connector 21 is operative, while the two connector members 22, 23 are simultaneously locked to each other and unintentional separation is prevented.

FIG. 5 of the drawing shows that the movable connector member 23 of the zero insertion force connector 21 has at its forward end a projection 33 and that a corresponding recess 34 is provided in the transverse wall 46 of the frame 40 of the stationary or mounted connector member 22. Projection 33 and recess 34 interact during the joining of the two connector members 23 and 22 in the same manner as already explained in connection with the projection 13 of the recess 14 illustrated in FIGS. 1–4. Projection 33 and recess 34 ensure that the two connector members 22 and 23 can only be joined if the locking slide member 27*a* and 27*b* of the movable connector member 23 is in the initial position. The purpose of this is to prevent damage to connector members 22 and 23 of the zero insertion force connector 21.

In order to further facilitate the joining of the connector members 23 and 22 when the locking slide members 27*a* and 27*b* are in the initial position, the projection 33 of the connector member 23 has an inclined portion 67 which serves to support the insertion of the projection 33 into the recess 34. The correctly joined and locked connector members 23 and 22 of the zero insertion force connector 21 are further secured in their position by providing a barb 68 at the projection 33 which is an edge 69 of the recess 54 as soon as the two connector members 22 and 23 have been moved into the relative position shown in FIG. 6.

While specific embodiments of the invention have been shown and described in detail to illustrate the application of the inventive principles, it will be understood that the invention may be embodied otherwise without departing from such principles.

We claim:

1. In an electric plug and socket-type connector including two complementary connector members which are coupled by moving one of the connector members in a direction of insertion, wherein one of the connector members has spring contacts as contact elements and the other connector member has blade contacts as contact elements, and wherein the contact elements are mounted in a row or in several parallel rows on base members, the improvement comprising the base members being mounted in frame-like enclosing members of housings which extend parallel to the direction of insertion of the contact elements, the frame-like enclosing members mutually guiding the housings during the insertion, contact slide members being displaceable along the row or rows of contact elements for placing the spring contacts and the corresponding blade contacts in contact with each other and out of contact from each other, locking slide members for positively coupling the connector members transversely of the direction of insertion, the contact slide members and the locking slide members being mounted on the same connector member, the contact slide members and the locking slide members being in engagement with a common swivel lever mounted on the same connector member as the contact slide members and the locking slide members, engagement means being provided between the contact slide members and the locking slide members, the engagement means operating such that, during the coupling procedure as well as the uncoupling procedure of the connector members, initially only the locking slide members are movable and the contact slide members are movable subsequently offset with respect to time.

2. The electric connector according to claim 1, wherein the locking slide members and the contact slide members are mounted on the connector member with the spring contacts.

3. The electric connector according to claim 1, wherein the spring contacts are spring-biased, the contact slide members moving the spring contacts against the spring bias in order to place them out of contact from the blade contacts.

4. The electric connector according to claim 1, wherein the engagement means between the contact slide members and the locking slide members comprises a slipping device.

5. The electric connector according to claim 4, wherein the slipping device is a pin and slot-connection.

6. The electric connector according to claim 4, wherein the connector member with the spring contacts has two outer longitudinal sides and a transverse side, a locking slide member being guided at each of the two outer longitudinal sides, the two locking slide members being mounted on side members of a stirrup, the stirrup further including a web connecting the side members and extending in front of the transverse side of the connector members.

7. The electric connector according to claim 6, the two side members defining oblong holes, the contact slide members including a common push rod, a transverse member extending parallel to the web member of the stirrup being connected to the push rod and engaging in the two oblong holes of the side members of the stirrup.

8. The electric connector according to claim 7, wherein the connector member with the blade contacts has two longitudinal side walls, each longitudinal side wall defining a locking guide slot which is open at an end thereof, each locking slide member having a locking cam engaging in one of the locking guide slots.

9. The electric connector according to claim 8, wherein the locking slide members are arranged at a distance from and parallel to inner surfaces of the stirrup side members, the locking cams being provided at outer surfaces on free ends of the locking slide members, such that the locking slide members act on inner surfaces of the longitudinal side walls of the connector member with the blade contacts.

10. The electric connector according to claim 9, wherein each contact slide member has an adjusting wedge for acting on a corresponding spring contact, a free space being defined at the contact slide members in front of each adjusting wedge, the spring bias of each spring contact biasing the spring contact into the free space.

11. The electric connector according to claim 10, wherein each stirrup side member has an end, a spring tongue being attached at the end of each stirrup side member, locking elements being mounted on each spring tongue, the locking elements being in engagement with locking engagement means provided in the longitudinal sides of the connector member with the spring contact, the locking engagement means being effective in at least an end position of the locking slide members.

12. The electric connector according to claim 11, wherein each longitudinal side wall of the connector member with the blade contacts has an end, the locking guide slots for the locking slide members being provided at or close to the end of the longitudinal side wall, a cutout being defined in a transverse wall of the connector member at another end thereof, the connector member with the spring contacts having at an end remote from the locking slide members a projection for engagement in the cutout.

* * * * *